US008789970B2

(12) United States Patent
Mahowald

(10) Patent No.: US 8,789,970 B2
(45) Date of Patent: Jul. 29, 2014

(54) COLOR COMPENSATION IN LED LUMINAIRES

(75) Inventor: Peter H. Mahowald, Los Altos, CA (US)

(73) Assignee: Lunera Lighting, Inc., Santa Clara, CA (US)

( * ) Notice: Subject to any disclaimer, the term of this patent is extended or adjusted under 35 U.S.C. 154(b) by 190 days.

(21) Appl. No.: 13/176,251

(22) Filed: Jul. 5, 2011

(65) Prior Publication Data

US 2013/0010453 A1 Jan. 10, 2013

(51) Int. Cl.
*F21S 4/00* (2006.01)

(52) U.S. Cl.
USPC ..... 362/249.02; 362/235

(58) Field of Classification Search
USPC ..... 362/249.01–249.02, 235; 315/113; 313/483
See application file for complete search history.

(56) References Cited

U.S. PATENT DOCUMENTS

2011/0095690 A1* 4/2011 Sagal ..... 315/113
2011/0204390 A1* 8/2011 Lerman et al. ..... 257/88

* cited by examiner

*Primary Examiner* — Anne Hines
(74) *Attorney, Agent, or Firm* — North Weber & Baugh LLP

(57) ABSTRACT

A luminaire in which color or brightness differences of light sources are compensated is provided. The luminaire can include several LED packages providing light to a primary optical component, which directs the light out of the luminaire. Because individual LED packages may output light at slightly different colors and/or brightness, the luminaire can include a secondary optical component having different materials that modify the color, brightness, or both of the output light. The secondary optical component can serve as a filter positioned between the LED packages (e.g., between a LED module) and the primary optical component, or between the primary optical component and the user, or above the primary optical component. The secondary optical component can be constructed by providing colorfast inks, phosphors, or quantum dots on a clear substrate or on a surface of the primary optical component. The materials can be disposed in a non-uniform manner.

10 Claims, 5 Drawing Sheets

COLOR COMPENSATION IN LED LUMINAIRES

BACKGROUND

Light fixtures provide light to illuminate dark environments. A light fixture or luminaire can include a light source and an optical component such as a light guide panel, a light guide array, or a diffuser that are mounted in a frame. To provide cost efficient and energy efficient luminaires, the light source used can include several light emitting diodes (LEDs) disposed in the luminaire. For example, several LEDs can be provided in an array on a circuit board. The light from each LED can be re-oriented or re-directed by the optical component to provide a uniform light output.

Each individual LED of an array of LEDs, however, may have slight differences due to manufacturing. The resulting color and/or brightness provided by the array of LEDs may differ or vary, which may cause unexpected variations that may be noticeable and affect the cosmetic appearance of the luminaire. One solution to alleviate this problem may be to carefully manufacture and select individual LEDs for their uniform color. This approach, however, may be time consuming and cost-prohibitive.

SUMMARY

A LED luminaire having a color compensating component is provided. A LED luminaire having a brightness compensating component is also provided.

A LED luminaire can include a frame for supporting a LED module having several LED packages, and a primary optical component for directing light from the LED packages out of the luminaire. Because several LED packages are used, the light provided by the LED module may differ in color, brightness, or both. To compensate for the color or brightness differences, the luminaire can include a secondary optical component that shifts the dominant wavelength of light created by each of the LED packages in a manner to provide a uniform color and brightness of light.

The secondary optical component can include colorfast ink, phosphorus material, quantum dots, or other such material that may shift the color of light, preferably with minimal impact to the brightness of the light. Colorfast ink can only absorb the colors that are present in the LED array in over abundance, but is an inexpensive option. Phosphors and quantum dots absorb photons of higher energy (bluer) and re-emit photons of lower energy (yellower or redder) and can be very efficient. The material may be disposed in a spatially modulated manner so as to shift the color or brightness of light in different manners based on the location within the secondary optical component. In this manner, the colorcompensation and/or brightness compensation provided by the secondary optical component may vary based on the properties and the position of each LED package.

The material used for the secondary optical component can be disposed within the luminaire in any suitable manner. In some cases, the material can be placed on a clear substrate that is positioned between the LED module and the primary optical component. Alternatively, the material can be provided directly on a surface of the primary optical component that is adjacent to the LED module. The material of the secondary optical component may be disposed in different manners. In a first case, the secondary optical component can be disposed between the primary optical component and the exterior of the luminaire. In this manner, direct compensation can be provided to the light emitted by the luminaire. In a second case, the secondary optical component may be disposed between the LED module and the primary optical component to shift the brightness or color of individual LED packages. In this manner, per-LED compensation can be provided to the light emitted by each LED package.

To determine which material to use for the secondary optical component (e.g., filter or fluorescent material), and where to place each material, the relationship between the gain required for a particular luminaire and filter values associated with each material can be determined. In some cases, an iterative process can be used by which several secondary optical components can be tried until a particular configuration that provides a suitable color profile or brightness profile is found. Then, the properties of the particular configuration can be compared with the determined gain for the luminaire to determine the relationship between the gain and the filter values for a type of luminaire. In some cases, the gain can be expressed as the product of a constant specific to the luminaire type, a spatial value, and the inverse of a filter value. Subsequent instances of the process can use the same gain factor with effective results.

BRIEF DESCRIPTION OF THE DRAWINGS

The above and other features of the present invention, its nature and various advantages will be more apparent upon consideration of the following detailed description, taken in conjunction with the accompanying drawings in which.

DETAILED DESCRIPTION

This is directed to a LED luminaire for which color and brightness of LED variations is compensated. The LED may be a band-gap semiconductor which emits light, and it may be a system composed of a band-gap semiconductor emitter whose light is converted by fluorescent phosphors, or quantum dots, to longer wavelength light.

Figure 1:
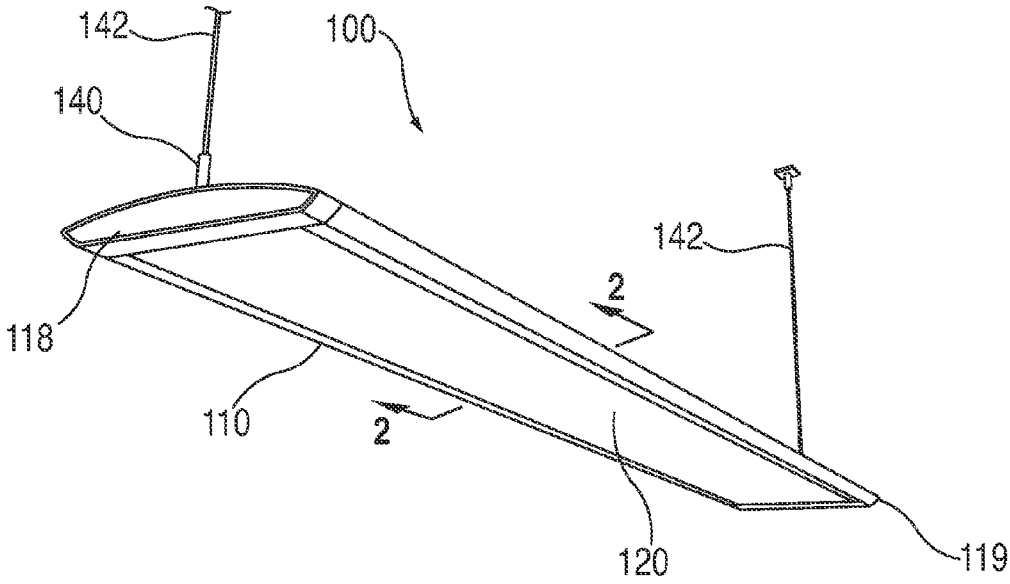
FIG. 1 is a perspective view of an illustrative LED luminaire in accordance with some embodiments of the invention.

A LED luminaire can be used to illuminate an environment. FIG. 1 is a perspective view of an illustrative LED luminaire in accordance with some embodiments of the invention. Luminaire 100 can include frame 110 providing a structure from which different components can be mounted. For example, frame 110 can include a center plate bordered by parallel walls. The center plate can include a substantially planar elongated component having any suitable dimensions including, for example, a width of less than 12", and a length of 4', 8', or another length larger than the width. In some cases, frame 110 can instead include a square center plate (e.g., 2'×2' plate) having side walls around the periphery of the square center plate. The center plate may be orientated such that a plane of the center plate is substantially parallel or co-planar with a ceiling or floor of an environment in which luminaire 100 is placed.

Luminaire 100 can include several LED light modules disposed within frame 110 to provide light out of the fixture. Each LED module can include several LED packages (e.g., LEDs) coupled to a circuit board (e.g., a PCB). The LED packages can be disposed in any suitable manner including, for example, as an array on the circuit board. In some cases, the circuit board and LED package disposition can be selected based on dimensions or features of frame 110. For example, LED packages can be disposed in a line on a rectangular circuit board to form an LED module providing edge lighting in an optical component. The LED module may then be secured adjacent to a wall of the frame. As another example, the LED module can be disposed in a planar surface on a circuit board to provide lighting from a top surface of an optical component. The LED module may then be secured to a center plate of the frame.

Because LED packages provide point sources of light, luminaire 100 can include optical component 120 for diffusing or otherwise modifying the light emitted by the LED packages. Optical component 120 can include, for example, a light guide array (LGA), a diffuser, a reflective component, or any other component providing optical effects to light emitted by the LED modules. The properties of optical component 120 can be defined to provide a desired illumination. For example, the optical component can be designed to provide a uniform illumination out of luminaire 100.

Luminaire 100 can be mounted in any suitable manner. For example, luminaire 100 can be ceiling mounted, wall mounted (e.g., a sconce), under-cabinet mounted, mounted to a pole or fixture, or combinations of these. In some cases, luminaire 100 can be dropped from a ceiling, for example using mounting brackets 140 at each of ends 118 and 119 of the luminaire. Mounting brackets 140 can be secured to frame 110, for example using a mechanical connector (e.g., a bolt or screw), a tab, interlocking components, hook and fastener material, an adhesive, tape, or any other connecting mechanism. Mounting brackets 140 can be disposed at any suitable position along luminaire 100. In some cases, mounting brackets 140 can be positioned near opposite ends of frame 110 to evenly support the luminaire. The distance between mounting brackets 140 can be determined, for example, based on the size or shape of frame 110 (e.g., place a mounting bracket at each end of the frame), the strength of each mounting bracket, the stiffness of the frame, cosmetic considerations, or other such considerations. In one implementation, mounting brackets can be provided at 4 feet or 8 feet intervals.

Each mounting bracket 140 can be coupled to cable 142 extending from the mounting bracket towards the ceiling. Cable 142 can have any suitable diameter including, for example, a small diameter to be more discrete. Cable 142 can be constructed from any suitable material having adequate structural or mechanical properties. For example, cable 142 can be constructed from metal, plastic, or a composite material. In some cases, cable 142 can be used to provide power to luminaire 100, for example by serving as a conductor, or by including a separate conductor bundled with the cable. Cable 142 can have any suitable length including, for example, a length based on the height of the ceiling relative to the floor, or a desired distance between luminaire 100 and a working surface (e.g., a desk in an office environment). At an end of cable 142 opposite mounting bracket 140, luminaire 100 can include connector 144. Connector 144 can include any suitable feature for being mounted to a ceiling. For example, connector 144 can include arms or other features for coupling to a rail on a ceiling. As another example, connector 144 can include a fastener to engage the ceiling.

Figure 2:
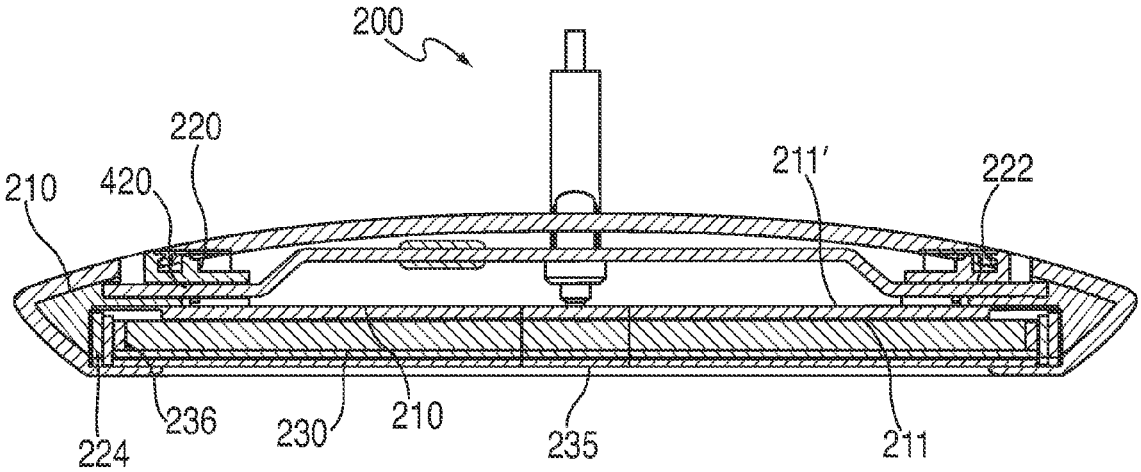
FIG. 2 is a sectional view of an illustrative LED luminaire in accordance with some embodiments of the invention.

FIG. 2 is a sectional view of an illustrative LED luminaire in accordance with some embodiments of the invention. Luminaire 200 can include some or all of the features of the luminaire described herein. Luminaire 200 can include frame 210 providing a structure for the luminaire. Frame 210 can include center plate 212 having a top surface 211' above which light can be emitted towards a ceiling (e.g., away from a work plane) and bottom surface 211 below which light can be directed towards an environment (e.g., towards a work plane). Luminaire 200 can include first LED module 220 mounted to a first side of frame 110, and second LED module 222 mounted to a second side of frame 210, where both LED modules are above center plate 212 (e.g., adjacent to top surface 211'). The LED modules can be positioned to emit light oriented substantially parallel to a plane of center plate 212 (e.g., perpendicular to a nadir of luminaire 200), for example in a cross-lighting configuration or to provide edge lighting to an optical component.

Luminaire 200 can include primary LED module 224 mounted to a side of frame 210 such that it is beneath center frame 212 (e.g., adjacent to bottom surface 211). In some cases, luminaire 200 can include several LED modules disposed in different positions on frame 210 for providing light beneath center frame 212 (e.g., towards a work plane). Luminaire 200 can include optical component 230 positioned adjacent to primary LED module 224 beneath center frame 212 to carry the light emitted by LED module 224 across the width of the luminaire. For example, LED module 224 can light optical component 230 from an edge (e.g., from an angle perpendicular to the nadir of luminaire 200).

Figure 3:
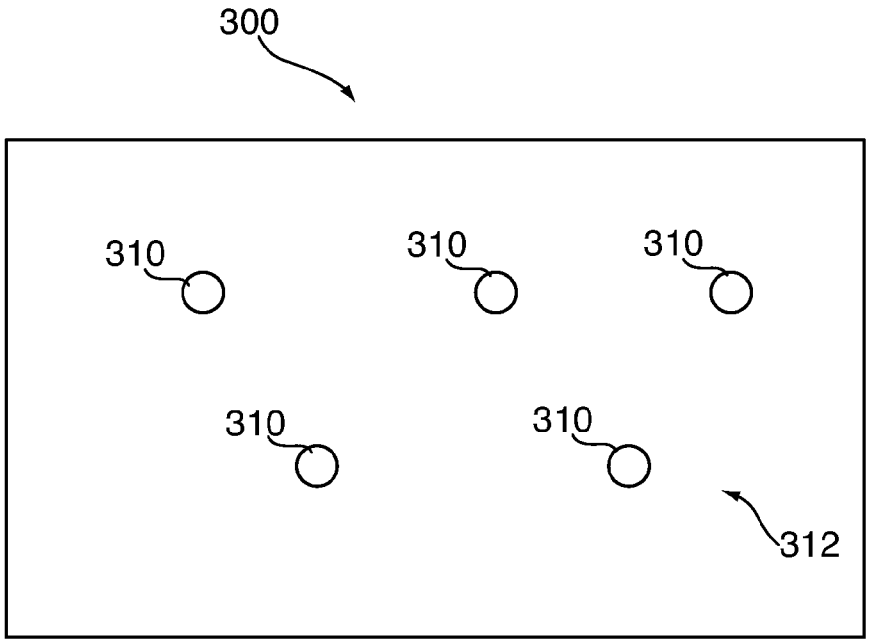
FIG. 3 is a schematic view of an illumination pattern provided by a luminaire in accordance with some embodiments of the invention.

Light emitted by a luminaire such as luminaire 100 (FIG. 1) and luminaire 200 (FIG. 2) can be directed towards a working plane. FIG. 3 is a schematic view of an illumination pattern provided by a luminaire in accordance with some embodiments of the invention. Pattern 300 can correspond to light visible to a user on a surface of an optical component of a luminaire. Pattern 300 can include light regions 310 that correspond to the placement of LED modules within the luminaire, and diffuse regions 320 between the light regions 310.

The light emitted by each LED package, however, may be slightly different. In particular, the color of each LED package may differ due to manufacturing variations, defects or artifacts. In addition, the brightness of light created by each LED package can differ. These changes in color and brightness in close proximity within the optical component can create an undesirable cosmetic effect. It may be desirable, therefore, to compensate for color and/or differences in the light provided in pattern 300 to improve a user's experience. In the discussions herein, it will be understood that embodiments describing adjusting color can also apply to adjusting brightness, and conversely that embodiments describing adjusting brightness can also apply to adjusting color.

Figure 4:
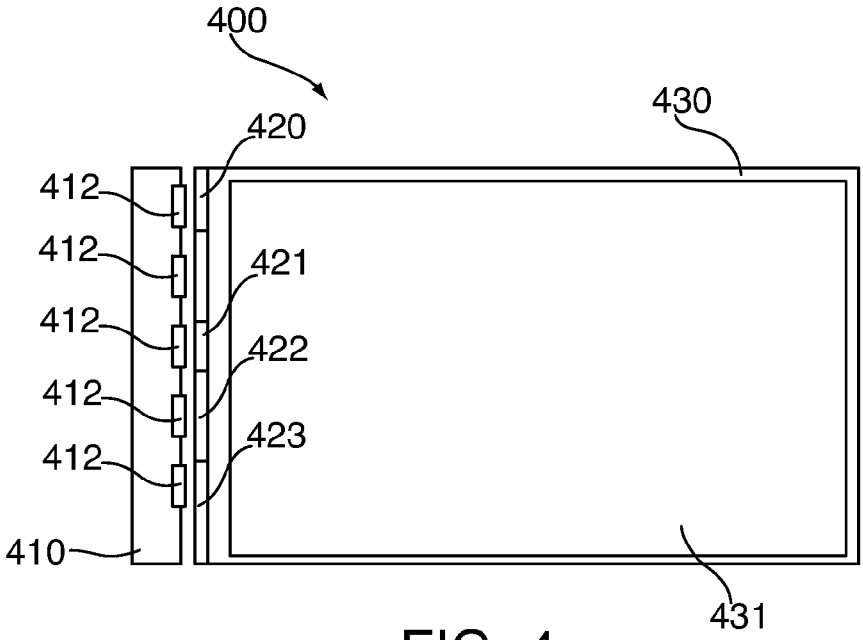
FIG. 4 is a top view of an illustrative portion of a luminaire in which colors are compensated in accordance with some embodiments of the invention.

One approach for correcting the color may be to provide a secondary corrective optical component that causes appropriate color shifts for each LED package in the luminaire. In particular, an approach can include modifying the secondary corrective optical component of the luminaire to compensate for color. FIG. 4 is a top view of an illustrative portion of a luminaire in which colors are compensated in accordance with some embodiments of the invention. Luminaire 400 can include LED module 410 having several LED packages 412, for example disposed in a line in the case of an edge-lit luminaire. Light emitted by each of LED packages 412 can be directed into optical component 430 so that it may be redirected towards a working plane.

Because the color and brightness of the light provided by the different LED packages 412 may be different, luminaire 400 can include a secondary optical component 420 positioned between LED module 410 and optical component 430 to provide color compensation (e.g., secondary optical component 236 between the LED array and 230 which is physically smaller and placed close to the LEDs and compensates each LED, as shown in FIG. 2). This approach can be known as "per-LED compensation." Secondary optical component 420 can include several different regions or portions having different properties that are tuned based on properties of the LED packages 412 of LED module 410. For example, each of regions 421, 422, and 423 can have different optical properties for shifting the color and/or brightness of one or more specific LED packages 412. In some cases, regions 421, 422, and 423 can include a continuous gradient or variation of optical properties (e.g., a color gradient). As light from LED module 410 passes through secondary optical component 420, the color and brightness of the light may be modified in places such that the resulting light reaching optical component 430 is of a uniform color and brightness.

Alternatively, luminaire 400 can include a secondary optical component 431 placed over optical component 430 (similar to pattern 300). For example, returning to FIG. 2, luminaire 200 can include a secondary optical component 235 between optical component 230 and the user space on which the compensation filter is placed. Alternatively, the secondary optical component can be placed above the primary optical component (e.g., such that the primary optical component is between the secondary optical component and the user) such that light reflecting internally within the luminaire can be modified when it passes through the secondary and primary optical components and exits the luminaire. This approach can be known as "direct compensation." Secondary optical component 431 may have any suitable size relative to optical component 430. For example, the secondary optical component 431 can be the same size as optical component 430. Alternatively, secondary optical component 431 can be sufficiently large to adjust the light passing through optical component 430.

Secondary optical component 420 or secondary optical component 431 can be constructed using any suitable approach. In some embodiments, ink can be printed on a clear substrate such that the ink can modify the color of the light passing through the substrate (e.g., to form a color filter). The ink can include, for example, colorfast inks or other inks that are stable with time in a bright environment.

In some cases, secondary optical component 420 and/or secondary optical component 431 can instead or in addition include phosphorus material that converts the color of light by absorbing higher energy photons and emitting lower energy photons while limiting any effects on brightness. In some cases, quantum dots can be used instead of or in addition to phosphorus material. In addition, the quantum dots can serve to add warmth or color rendition to the light provided to primary optical component 430.

In some cases, secondary optical component 420 can be integrated with primary optical component 430. For example, the material used to shift the color of emitted light and/or adjust the brightness can be provided directly on a surface of primary optical component 430. In particular, material can be printed directly on an edge of an LGA for per-LED compensation, or on another surface of the LGA that receives light from a LED package, for example the user face for direct compensation.

In some cases, the secondary optical component may be patterned with spatially non-uniform phosphors, fluorescent quantum dots, or other fluorescent materials. The pattern may present to the user a pleasing pattern, such as clouds, or a motif that complements the décor of the ceiling or room. The pattern may be for example a company logo or other artwork. In some cases, the pattern used for the secondary optical component can serve for branding or marking purposes.

Any suitable approach can be used to determine the optical properties required for constructing a secondary optical component providing accurate color or brightness compensation. In some cases, an image of the light fixture can be captured using a camera designed to record color faithfully. The resulting image can be analyzed to identify color variations in the light provided by the individual LED packages of the luminaire. The analysis can include, for example, determining a desired color profile for light emitted by the luminaire, and comparing the desired color profile with the color profile captured by the camera to calculate a gain factor between the two color profiles. The color camera may be a three color camera common to colorimetry test gear, or a multiple-channel imaging sensor with a multitude of color channels. A sensor with a large number of channels such as a spectroradiometer may be scanned over the surface of the luminaire using a mechanical apparatus. In some cases, the desired color profile can be defined relative to the recorded color profile of the luminaire (e.g., the desired color profile is an average color, or one of the colors identified in the recorded color profile). The gain factor can, in some cases, vary based on the particular region of the optical component, or based on the LED package providing light to the region.

Once the gain factor has been determined for optical component, specific optical components can be defined using the gain factor. The optical components can be defined, for example, based on properties of the ink, phosphorus material, quantum dots, or other material used for secondary optical component. For example, if several different materials or colors each having different color properties (e.g., different color inks or phosphorus materials) are available, each region may require an optical component having a particular combination of the available materials. Using information describing color properties, cost, efficiency, transparency, or other optical properties of the material, a particular optical component making use of the available materials can be created.

In some cases, the optical component can be created as an iterative process. For example, a first optical component can be created and placed in the luminaire. The resulting color profile for light emitted by the luminaire can be captured by the camera, and again compared to a desired color profile. A new gain can be computed, and a new optical component that includes properties of the first optical component and of the new gain can be created and tested. Optical components can be iterated until the color profile provided by the luminaire is within a maximal limit of the desired color profile. In some cases, the limit can allow for some variation. For example, the limit may allow variation over long distances, which may be less perceptible to the human eye.

In some cases, the optical component can instead be defined based on the gain factor. For example, in the case of direct compensation, computation of the correct filter can be fairly straightforward. For a given spot on the face of the luminaire, the properties of the absorptive filter shift the spectrum as predicted by multiplying the filter's transmissivity by the amount of light at that spot, for each wavelength. For a phosphor or quantum dot, the computation absorbs light as described by multiplying the absorption spectra of the phosphor or quantum dot by the amount of light at that spot for each wavelength, and adds the emission from the quantum dot by summing the amount of light at that spot of the luminaire left after absorption to the emission spectra of the phosphor or quantum dot.

Figure 5:
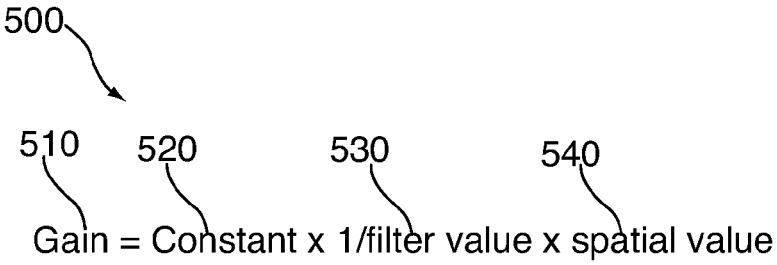
FIG. 5 is an illustrative equation relating a gain to a filter value in accordance with some embodiments of the invention.

In the case of per-LED compensation, the gain, which is computed by comparing captured color profiles with desired color profiles, can include a value that is expressed as a function of location. In particular, the gain required can vary based on the observed location on the primary optical component (e.g., distinguishing different color regions in illumination pattern 300, FIG. 3). The gain can be translated to particular optical component properties using any suitable approach. For example, the gain can be expressed as shown in the equation of FIG. 5. The gain 510 is equal to the product of a constant with the inverse of a filter value for particular materials and a spatial value. In some cases, the equation of FIG. 5 can also apply to direct compensation approaches for optical components.

The constant can be a value that is specific to the luminaire or to the design of the primary optical component used for the luminaire. In particular, the constant can reflect the type of LGA used, properties of the diffuser, properties of other components within the luminaire, or other such properties. The constant may be the same for all luminaires constructed according to a particular design. To determine the constant, a secondary optical component (e.g., a filter) can be created using an iterative process or by trial and error for a particular design. Once the secondary optical component has been created, the filters used may be analyzed and the constant calculated.

The filter value can be the expression of the color shifting properties of a particular material used for the filter. For example, particular ink may shift the color of light passing through the ink by a different amount than a similarly colored quantum dot. In some cases, the filter value can be known from the source or manufacturer of the material used for the filter. A secondary optical component can include several different materials each having different filter values. If several materials are overlaid in a particular region of a secondary optical component, the gain for that particular region may take into account a combination of the filter values (e.g., a sum of the inverses of the filter values for the several materials used).

In some cases, it may be necessary to use several different materials, and thus several different filter values to reach a particular gain for each location of the secondary optical component (e.g., or of the surface of the primary optical component adjacent to which the secondary optical component is placed). In some cases, it may be beneficial to have a large variety of materials, and thus of filter values, to reach a particular gain. In some cases, the material used can include phosphorus material, which may be typically provided in three or four colors (e.g., corresponding to the RGB colors). Alternatively, quantum dots, which can be customized in a larger number of colors that are more specifically tailored for LEDs or for luminaires, can be used. In this manner, more channels in the capture of the initial color data, combined with more different quantum dot colors will enable a better compensation. In some cases, a computer program or other machine can be used to determine a most efficient, most accurate, or most cost-effective combination of materials to reach a desired gain.

The spatial value can account for the superposition of the several LED packages in the luminaire. To determine the spatial value for each location, each LED package can be individually activated. The resulting light transmitted by the luminaire can be analyzed, and the effect of the activated LED package on each location of the primary optical component or on the light output by the luminaire can be quantified. Alternatively, ray tracing optical models can map the color and brightness of the diffuser facing the user to the color and brightness of each LED supplying light to the luminaire. The spatial value for the filter materials each location can then be determined as a combination of the quantified effect of each LED package (e.g., as a sort of location-specific average of the effect of each LED package on the location).

Figure 6:
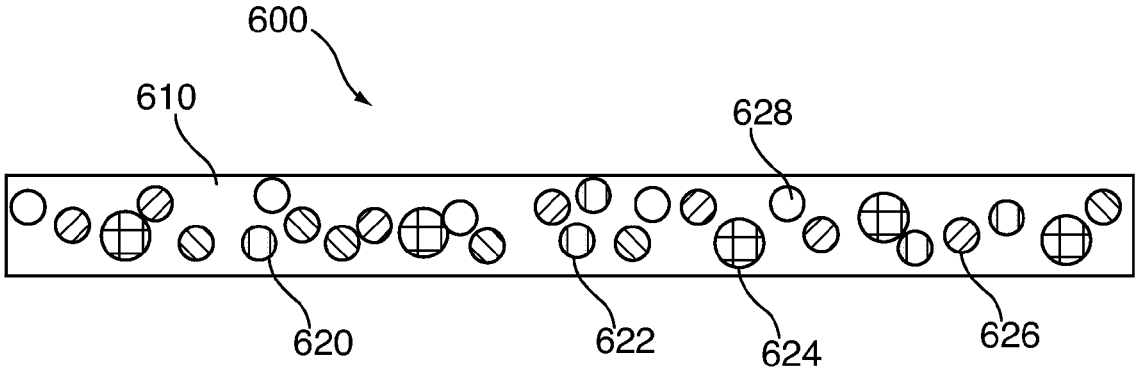
FIG. 6 is schematic view of an illustrative secondary optical component in accordance with some embodiments of the invention.

The material used to create a secondary optical component can be disposed in any suitable configuration. FIG. 6 is schematic view of an illustrative secondary optical component in accordance with some embodiments of the invention. Secondary optical component 600 can include substrate 610 on which material having optical properties is provided. Different materials can be provided on various regions of substrate 610 based on the desired gains for the various regions. For example, substrate 610 can include regions having materials 620, 622, 624, 626, and 628, where each of the materials has different optical properties. The particular number of materials used may depend, for example, on the available materials, or on optical properties required to attain a desired gain.

Each material can be provided as one or more marks having any suitable shape or dimension. For example, the materials can be provided as dots of a particular diameter, where some dots may overlap. As another example, the materials can be provided as lines, polygons, circular marks, arbitrarily shaped marks, or combinations of these. The dimensions of each mark can be selected, for example, based on the gain requirements, properties of the materials (e.g., some materials may not adhere is small sizes), or combinations of these. In some cases, several marks of different materials can overlap, for example, to provide a particular gain.

The marks can be provided on substrate 610 using any suitable approach. In some cases, a printing process can be used. For example, an ink jet printer can be used to output dots of colorfast ink. As another example, silk screening or lithographical process can be used. For example, a lithographic technique (or a chemical or ion implantation method) can be used to adhere quantum dots to the substrate.

In some cases, the material used for the secondary optical component can also serve to compensate or adjust the brightness of light emitted by the LED packages. For example, the captured image of the luminaire can instead or in addition be analyzed for variations in brightness. A corresponding filter or secondary optical component that adjusts brightness can be created and incorporated in the luminaire.

Figure 7:
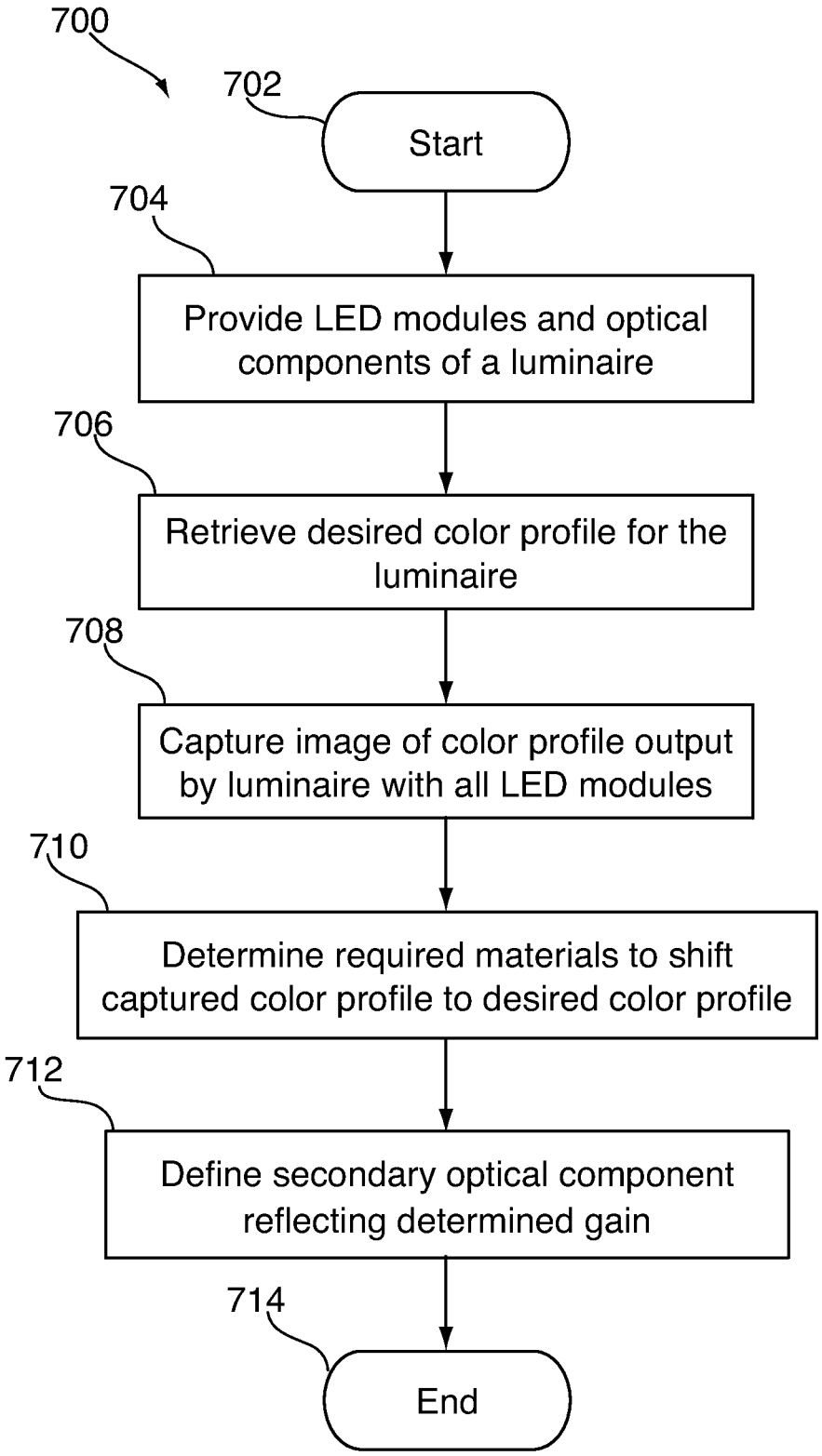
FIG. 7 is a flowchart of an illustrative process for defining an optical component for compensating color in accordance with some embodiments of the invention.

FIG. 7 is a flowchart of an illustrative process for defining an optical component for compensating color and/or brightness for "direct compensation" in accordance with some embodiments of the invention. Process 700 can begin at step 702. At step 704, LED modules and optical components of a luminaire can be provided. For example, a frame or body of a luminaire, along with one or more LED modules and a primary optical component for directing light from the LED modules out of the luminaire can be provided. At step 706, a desired color profile for the luminaire can be retrieved. For example, a color profile associated with a particular type of luminaire can be retrieved. As another example, the desired color profile can be retrieved or defined based on a captured color profile of the luminaire (e.g., captured at step 708). At step 708, an image of the light output by the luminaire when the LED modules are activated can be captured to generate a captured color profile of the luminaire. The captured color profile can include variations in color due to variations in the color of the underlying LED packages of the LED modules.

At step 710, the filter materials required to shift the captured color profile to the desired color profile can be determined. For example, the captured color profile and the desired color profile can be compared and the difference between the two quantified as a gain. The gain can be expressed as a function of position on the primary optical component (i.e., the gain required varies based on the region of the optical component that is observed). At step 712, a secondary optical component reflecting the determined gain can be defined. For example, several materials each shifting color in different manners can be applied to a substrate or to a surface of a primary optical component to provide the determined gain. The amount of each material to provide, as well as the position on the substrate for each of the materials, can be determined using an equation specific to the luminaire (e.g., an equation such as equation 500, FIG. 5). Process 700 can then end at step 710.

Figure 8:
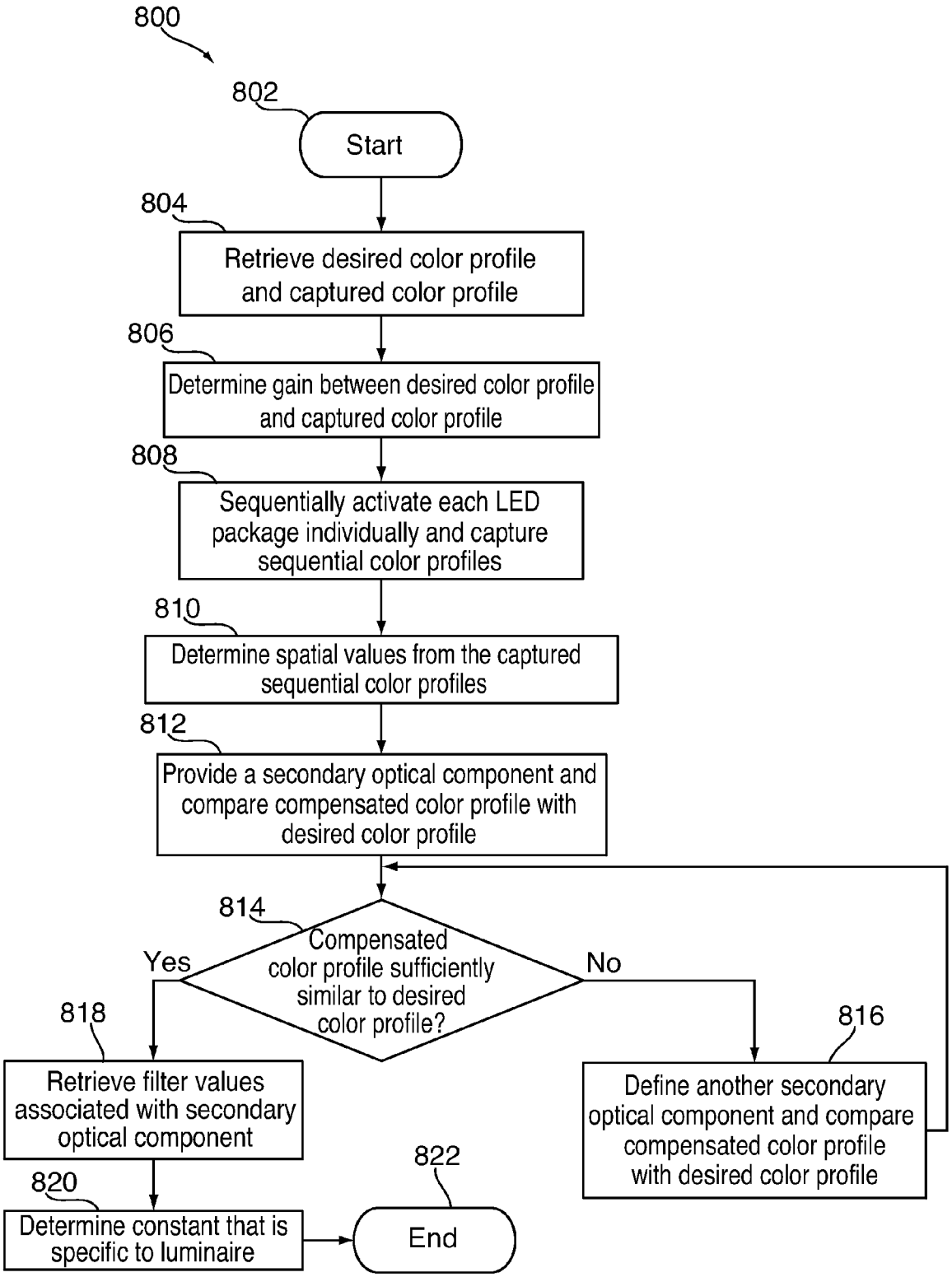
FIG. 8 is a flowchart of an illustrative process for determining the factors relating a gain to a filter value corresponding to the materials used for a secondary optical component in accordance with some embodiments of the invention.

FIG. 8 is a flowchart of an illustrative process for determining the factors relating a gain to a filter value for the case of "per LED compensation" corresponding to the materials used for a secondary optical component in accordance with some embodiments of the invention. Process 800 can begin at step 802. At step 804, a desired color profile and a captured color profile can be retrieved. For example, an image of the light output by the luminaire can be captured using a camera that records color faithfully. At step 806, the gain between the desired color profile and the captured color profile can be determined. The gain can be expressed as a function of location or position on a primary optical component.

At step 808, each LED package of one or more LED modules of the luminaire can be sequentially and individually activated. A color profile corresponding to each LED package can then be captured. The captured sequential color profiles can each show an illumination in a small region of the primary optical component. At step 810, spatial values can be determined from the captured sequential color profiles. For example, for each location on the primary optical component, a spatial value expressing the amount of light provided each of the LED packages to the location can be determined. In some cases, the spatial value can instead or in addition be determined relative to the secondary optical component.

At step 810, a secondary optical component for compensating the color of the LED modules can be constructed and provided in the luminaire. An image of the color profile created using the secondary optical component can be captured and compared with the desired color profile. At step 812, it can be determined whether the compensated color profile is sufficiently similar to the desired color profile. If the compensated color profile is determined not to be sufficiently similar to the desired color profile, process 800 can move to step 816. At step 816, another secondary optical component having a different disposition of materials that shift color can be defined, and a color profile of the luminaire having the other secondary optical component can be captured and compared with the desired color profile. Process 800 then return to step 814.

If, at step 814, the compensated color profile is determined to be sufficiently similar to the desired color profile, process 800 can move to step 818. At step 818, filter values associated with the secondary optical component can be retrieved. For example, for each location on the secondary optical component (e.g., where material shifting color is present), a filter value corresponding to the materials used can be retrieved. At step 820, a constant specific to the luminaire can be determined. For example, an equation can be solved for each location of the secondary optical component to determine a constant factor. In some cases, the constant may be a function of location, although it may be the same for all locations as other factors in the equation relating gain to filter values may be location-specific. Process 800 can then end at step 822. Using this approach, the constants and spatial values can be determined for a particular fixture and LGA. It will be assumed that the LGAs of a particular design are substantially the same so that the same constants and factors used to calculate the gain can be applied to determine an appropriate secondary optical component for any luminaire of that design.

It is to be understood that the steps shown in processes 700 and 800 of FIGS. 7 and 8 are merely illustrative and that existing steps may be modified or omitted, additional steps may be added, and the order of certain steps may be altered. Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The above-described embodiments of the invention are presented for purposes of illustration and not of limitation.

What is claimed is:

1. An LED luminaire, comprising:

an LED module comprising a plurality of LEDs, wherein at least two LEDs vary in their LED color profiles;

a primary optical component placed adjacent to the LED module, the primary optical component operative to direct light from the LED module out of the luminaire; and a secondary optical component that receives light having a color profile that comprises a nonuniformity caused by the varying LED color profiles, the secondary optical component shifts the color profile to reduce the nonuniformity.

2. The LED luminaire of claim 1, wherein the secondary optical component further comprises:

a spatially modulated phosphorus material.

3. The LED luminaire of claim 2, wherein:

the spatially modulated phosphorus material is disposed as a plurality of quantum dots.

4. The LED luminaire of claim 1, wherein the secondary optical component further comprises:

a colorfast ink printed on a substrate.

5. The LED luminaire of claim 1, wherein the secondary optical component further comprises:

a plurality of quantum dots disposed on a substrate.

6. The LED luminaire of claim 1, wherein:

the secondary optical component comprises at least one mark of a material operative to shift the color of light.

7. The LED luminaire of claim 6, wherein:

the at least one mark is provided on a surface of the primary optical component that is adjacent to the LED module.

8. The LED luminaire of claim 6, wherein the secondary optical component further comprises:

a substrate positioned between the LED module and the primary optical component, wherein the at least one mark is provided on the substrate.

9. The LED luminaire of claim 6, wherein the secondary optical component further comprises:

a plurality of different materials disposed on a substrate, wherein each of the plurality of different materials is operative to shift the color of light by a different amount.

10. An apparatus for providing a brightness modulated image, comprising:

an LED module comprising a plurality of LEDs, wherein at least two LEDs vary in LED brightness;

a primary optical component placed adjacent to the LED module, the primary optical component directs light from the LED module out of a luminaire; and a secondary optical component that receives light having a nonuniformity resulting from the variations in the LED brightness, the secondary optical component shifts a color profile of the LEDs to provide a light output with an increased uniformity in brightness.

* * * * *